US007149464B2

(12) United States Patent
Yoneda et al.

(10) Patent No.: US 7,149,464 B2
(45) Date of Patent: Dec. 12, 2006

(54) BELT-TYPE FIXING DEVICE

(75) Inventors: Satoru Yoneda, Toyohashi (JP); Noboru Yonekawa, Toyohashi (JP); Yutaka Otsuka, Toyokawa (JP); Shigeo Nakamura, Okazaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 10/805,250

(22) Filed: Mar. 22, 2004

(65) Prior Publication Data

US 2004/0184850 A1 Sep. 23, 2004

(30) Foreign Application Priority Data

Mar. 20, 2003 (JP) ..... 2003-077072
Mar. 20, 2003 (JP) ..... 2003-077076

(51) Int. Cl.
*G03G 15/20* (2006.01)

(52) U.S. Cl. ..... 399/329; 399/331; 399/333

(58) Field of Classification Search ..... 399/329, 399/328, 333, 400, 331
See application file for complete search history.

(56) References Cited

U.S. PATENT DOCUMENTS 4,149,797 A * 4/1979 Imperial ..... 399/331
5,666,624 A * 9/1997 Kanesawa et al. ..... 399/329
5,866,875 A * 2/1999 Okabayashi ..... 399/329
6,490,429 B1 * 12/2002 Okayasu et al. ..... 399/328
6,671,489 B1 * 12/2003 Natsuhara et al. ..... 399/329
6,795,678 B1 * 9/2004 Yura et al. ..... 399/329
2004/0131401 A1 * 7/2004 Nakatogawa et al. ..... 399/328
2005/0047838 A1 * 3/2005 Uehara et al. ..... 399/329

FOREIGN PATENT DOCUMENTS

JP 3-228076 10/1991
JP 04284481 A * 10/1992
JP 10-228195 8/1998
JP 11-133776 5/1999
JP 2001-356625 12/2001
JP 2002-148979 5/2002

* cited by examiner

*Primary Examiner*—Diego Gutierrez
*Assistant Examiner*—Travis Reis
(74) *Attorney, Agent, or Firm*—Morrison & Foerster LLP

(57) ABSTRACT

A belt-type fixing device is provided in which a wide fixing nip having a generally flat pressure distribution with respect to a paper feeding direction can be formed.

The belt-type fixing device of the invention has a nip forming member that is fixed inside an endless-sheet-like fixing belt to be heated so as to be incapable of rotating, and a rotatable pressurizing roller that is in pressure contact with the nip forming member with the fixing belt interposed between. Contact part between the fixing belt and the pressurizing roller forms a fixing nip, and a surface of the nip forming member that is opposite to the pressurizing roller is configured as a curved surface extending along an outer circumferential surface of the pressurizing roller so that a pressure distribution in the fixing nip is made generally flat with respect to the paper feeding direction.

15 Claims, 6 Drawing Sheets

BELT-TYPE FIXING DEVICE

RELATED APPLICATIONS

This application is based on Japanese Patent Applications Nos. 2003-77072 and 2003-77076, the contents of which are incorporated herein by reference.

BACKGROUND OF THE INVENTION

The present invention relates to a belt-type fixing device that is used in an electrophotographic image forming apparatus.

In Japanese Patent Laid-Open Publication 2001-356625, a fixing device has been disclosed in which pressure contact of a pressurizing pad with a thermal fixing roller having a heat source therein through an endless belt forms a fixing nip between the thermal fixing roller and the endless belt. In the fixing device, the thermal fixing roller has an elastic layer on an outer circumference thereof, and the elastic layer is pressed by the pressurizing pad through the endless belt so as to be strained. The fixing device is configured so that nip pressures in the fixing nip is larger in vicinity of an exit for a recording sheet.

Such a variation in the nip pressure in the fixing nip, however, results in a variation in amount of strain of the elastic layer on the thermal fixing roller. Such a difference in amount of strain of the elastic layer on the thermal fixing roller with respect to a sheet conveying direction in the fixing nip leads to a little difference in sheet conveying velocity among areas in the fixing nip with respect to the sheet conveying direction. The difference in conveying velocity in the fixing nip causes a problem in that the difference stresses a sheet passing through the nip and causes image noise such as image blur, wrinkles of paper or the like.

SUMMARY OF THE INVENTION

In order to solve the problem described above, a belt-type fixing device in accordance with an aspect of the invention has a nip forming member that is fixed inside an endless-sheet-like fixing belt to be heated so as to be incapable of rotating, and a rotatable pressurizing roller that is in pressure contact with the nip forming member with the fixing belt interposed between, wherein contact part between the fixing belt and the pressurizing roller forms a fixing nip, and a surface of the nip forming member that is opposite to the pressurizing roller is configured as a curved surface extending along an outer circumferential surface of the pressurizing roller so that a pressure distribution in the fixing nip is made generally flat with respect to a paper feeding direction.

In the belt-type fixing device of the invention, the pressurizing roller may have an elastic layer on an outer circumference thereof and the nip forming member may be composed of material that is harder than the elastic layer.

In the belt-type fixing device of the invention, the nip forming member may cause a radial strain not less than 0.3 mm in the elastic layer of the pressurizing roller with a mean pressure not less than 80 kPa.

In the belt-type fixing device of the invention, a heat source for heating the fixing belt may be provided in a position away from the fixing nip, and a thermal conductivity of the elastic layer of the pressurizing roller may be 0.3 W/(m·K) or less.

In the belt-type fixing device of the invention, a thickness of the elastic layer of the pressurizing roller may be not less than 4 mm.

In the belt-type fixing device of the invention, the surface of the nip forming member that is opposite to the pressurizing roller may be curved so that middle part of the nip forming member with respect to a longitudinal direction may protrude relative to both ends toward the pressurizing roller.

In the belt-type fixing device of the invention, a radius r1 of curvature of the curved surface and a radius r2 of curvature of the pressurizing roller may be set so that a relation of the following expression 1 may hold:

$$r2 \leqq r1 \leqq r2 \cdot K \quad \text{(Expression 1)}$$

(wherein $1 \leqq K < 1.13$)

In the belt-type fixing device of the invention, a mean radius r1 of curvature of the curved surface and the radius r2 of curvature of the pressurizing roller may be set so that a relation of the following expression 2 may hold:

$$r2 \leqq r1 \leqq r2 \cdot K \quad \text{(Expression 2)}$$

(wherein $1 \leqq K \leqq 1.3$)

In the belt-type fixing device of the invention, the pressurizing roller may have an elastic layer on the outer circumference thereof and the elastic layer may have a JIS-A hardness in a range from 5 to 40.

In the belt-type fixing device of the invention, a mean pressure in the fixing nip may be not less than 50 kPa and not more than 250 kPa.

In the belt-type fixing device of the invention, the fixing belt may be wound around a rotatable heating roller having a heat source and around the nip forming member provided in a position away from the heating roller.

A belt-type fixing device for fixing a toner image on a paper in accordance with another aspect of the invention has:

an endless-sheet-like belt member, a pressurizing roller which has an elasticity and on which the paper is passed through a fixing nip that is contact part between the pressurizing roller and an outer circumferential surface of the belt member, and a nip forming member that is harder than the pressurizing roller, that is positioned inside the belt member, that relatively presses the belt member against the pressurizing roller, and that has a pressing surface opposite to the pressurizing roller and formed of a curved surface extending along an outer circumferential surface of the pressurizing roller.

In the belt-type fixing device of the another aspect, a radius of curvature of the pressing surface of the nip forming member may be substantially equal to a radius of curvature of the outer circumferential surface of the pressurizing roller.

In the belt-type fixing device of the another aspect, a radius r1 of curvature of the pressing surface of the nip forming member and a radius r2 of curvature of the outer circumferential surface of the pressurizing roller may be set so that a relation of the following expression 3 may hold:

$$r2 \leqq r1 \leqq r2 \cdot K \quad \text{(Expression 3)}$$

(wherein $1 \leqq K < 1.13$)

In the belt-type fixing device of the another aspect, the pressing surface of the nip forming member may be formed of one and the same material continuously.

In the belt-type fixing device of the another aspect, when the pressurizing roller is driven to rotate, the belt member follows the pressurizing roller and thereby rotates.

In accordance with the belt-type fixing device of the invention, the surface opposite to the pressurizing roller of the nip forming member that is fixed so as to be incapable of rotating is configured as the curved surface extending along the outer circumferential surface of the pressurizing roller, and the pressure distribution in the fixing nip is thereby made generally flat with respect to the paper feeding direction, so that paper conveying velocities are made uniform throughout the fixing nip. Thus stress is prevented from occurring in a paper passing through the fixing nip, and image noise such as image blur, wrinkles of paper and the like are thereby prevented from occurring.

In accordance with the belt-type fixing device of the invention, the fixing nip having a desired width can be obtained with adequate setting of a width of the nip forming member. Accordingly, the fixing nip having a large width is easily obtained by a comparatively low nip pressure, in contrast to a conventional fixing device in which a fixing nip is formed between two rollers and which requires a considerably large contact pressure for obtainment of a wide fixing nip. Thus nip time required for fixation is ensured by the wide fixing nip, so that increase in system speed of the image forming apparatus can be addressed.

The fixing device can be miniaturized and a circumference of the fixing belt can be shortened by substitution of the nip forming member for a fixing roller having an elastic layer on an outer circumference thereof which roller has been used in conventional belt-type fixing devices. Thus the fixing belt can be shortened so that a heat capacity of the fixing belt and heat release from the fixing belt are reduced. Furthermore, substitution of the nip forming member, e.g., made of resin with a small heat capacity for a fixing roller having an elastic layer with a large heat capacity increases a rate at which temperatures rise in the fixing belt being heated. As a result, warm-up time at a start and recovery time from printing-standby status can be shortened.

On condition that a pressure contact load of the pressurizing roller is variable in accordance with a type of a paper in the belt-type fixing device of the invention, positions of an entrance and an exit of the fixing nip do not change so much as those in a conventional fixing device in which a fixing nip is formed between two rollers. Therefore, deterioration is prevented in performance on plunge of paper into the fixing nip and performance on separation of paper ejected from the fixing nip.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
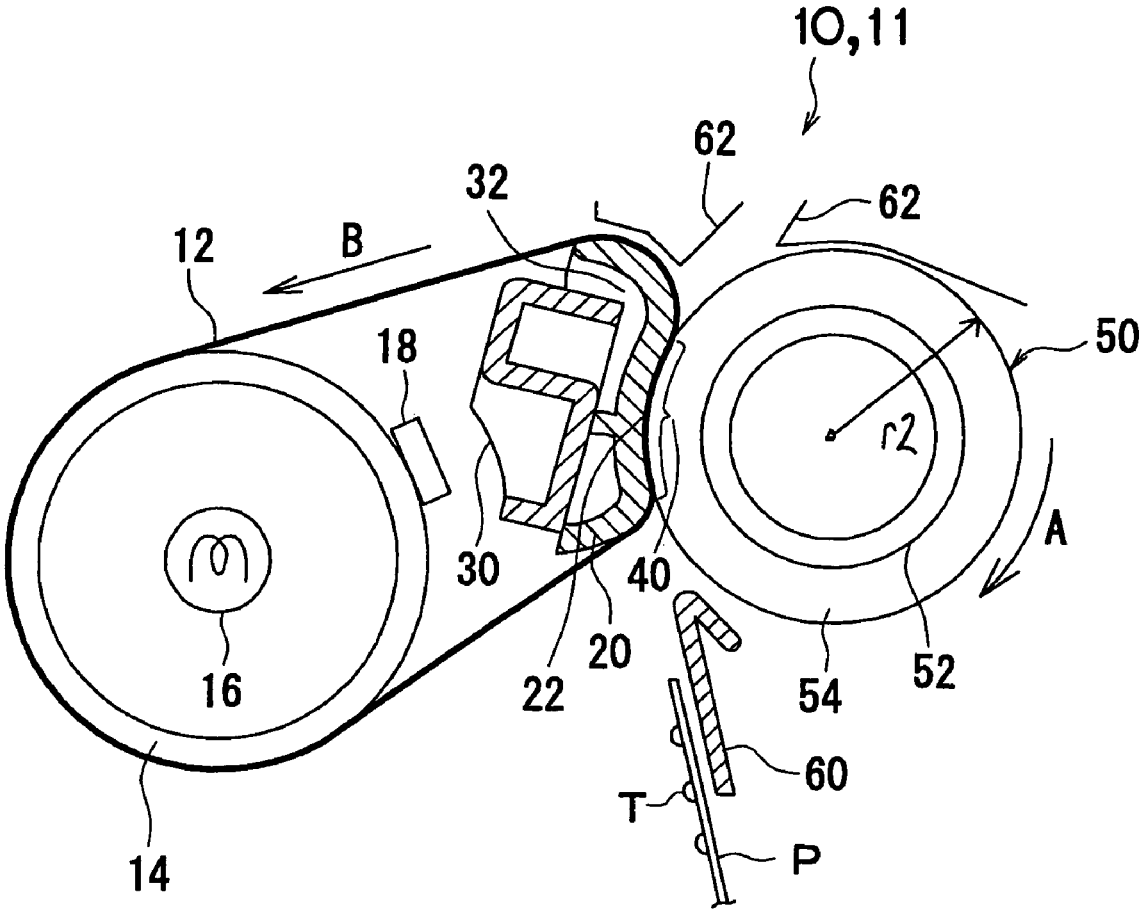
FIG. 1 shows a general configuration of a belt-type fixing device.

FIG. 1 shows a belt-type fixing device 10 in accordance with a first embodiment of the invention. The belt-type fixing device 10 has an endless-sheet-like fixing belt 12. The fixing belt 12 is composed of a base element which has, for example, an outside diameter of 50 mm when the belt is in form of a cylinder and a thickness of 70 μm, and which is made of polyimide, a 200 μm-thick elastic layer made of silicone rubber, and a 30 μm-thick mold release layer made of PFA (copolymer of tetrafluoroethylene and perfluoroalkyl vinylether), in such a manner that they have been superimposed in order of mention from inside of the belt.

The fixing belt 12 is wound around a heating roller 14 that is rotatably supported at both ends thereof and around a nip forming member 20 that is fixed in a position away from the heating roller 14 so that the member 20 cannot be rotated. The heating roller 14 is composed of a cylindrical metal tube having an outside diameter of 35 mm, for example, and has a heater lamp 16 as a heat source therein. The heating roller 14 is biased by a spring not shown in a direction such that the heating roller 14 goes away from the nip forming member 20, and a specified tension is thereby imparted to the fixing belt 12.

The fixing belt 12 is heated by the heating roller 14 heated from inside by the heater lamp 16. A thermistor 18 is provided so as to be in contact with the heating roller 14. Temperatures of the heating roller 14 and the fixing belt 12 can be set at desired values by on-off control over the heater lamp 16 according to a temperature detected by the thermistor 18.

The nip forming member 20 is provided inside the fixing belt 12, and a pressurizing roller 50 is in pressure contact with the nip forming member 20, with the fixing belt 12 interposed between. Thus contact part between the fixing belt 12 and the pressurizing roller 50 forms a fixing nip 40.

The pressurizing roller 50 has an outside diameter of 30 mm, for example, and has a 4 mm-thick elastic layer 54 composed of rubber or sponge on an outer circumference of a metal core 52 that is like a metal cylinder. A 40 μm-thick mold release layer (not shown) is formed on a surface of the elastic layer 54. The pressurizing roller 50 is driven by a motor not shown to rotate in a direction of an arrow A. Inside the pressurizing roller 50 may be provided an auxiliary heater.

The elastic layer 54 of the pressurizing roller 50 has a length of 241 mm, for example, along an axial direction (a direction of depth in FIG. 1). The fixing belt 12 has a width larger than the length of the elastic layer 54 so that the whole length of the elastic layer 54 of the pressurizing roller 50 is in pressure contact with the fixing belt 12. The nip forming member 20 extends so as to support an overall width of the fixing belt 12.

The nip forming member 20 is formed of material (such as resin and ceramic) that has a low heat conductivity and that is harder than the elastic layer 54 of the pressurizing roller 50. A low friction layer (not shown) composed of PFA, PTFE (polytetrafluoroethylene) or the like, for example, is formed on a surface of the member 20 that is in contact with an inner surface of the fixing belt 12. In order to reduce a frictional resistance between the nip forming member 20 and the fixing belt 12, heat-resistant lubricant such as fluorine-based grease may be applied onto the inner surface of the fixing belt 12.

A surface (or pressing surface) 22 of the nip forming member 20 that is opposite to the pressurizing roller 50 is configured as a curved surface that extends along an outer circumferential surface of the pressurizing roller 50. Specifically, a radius of curvature of the opposite surface 22 of the nip forming member 20 is the same as a radius of curvature of the outer circumferential surface of the pressurizing roller 50 (e.g., 15 mm) or is a little larger (e.g., 15.4 mm) than that. In such a configuration, a length of the fixing nip 40 with respect to a circumferential direction of the pressurizing roller 50 is about 12 mm (hereinbelow, the length of the fixing nip will be referred to as "nip width"). Thus the surface 22 of the nip forming member 20 that is opposite to the pressurizing roller 50 is configured as the curved surface extending along the outer circumferential surface of the pressurizing roller 50, and a pressure distribution in the fixing nip 40 is thereby made generally flat with respect to a paper feeding direction.

The opposite surface 22 of the nip forming member 20 is formed of one and the same material continuously. For example, the material may be resin material that forms the nip forming member 20 or may be rubber material, fluorine coating material or the like that covers the opposite surface 22 of the nip forming member 20.

At back of the nip forming member 20, a reinforcing member 30 that is made of a metal plate bent into a cross-sectional shape like a letter "S" is provided so as to extend in a longitudinal direction of the nip forming member 20. The reinforcing member 30 is intended for minimizing flexure of the nip forming member 20 in directions orthogonal to the longitudinal direction which flexure is caused by pressure of the pressurizing roller 50. Between the nip forming member 20 and the reinforcing member 30 is provided a space 32 intended for heat insulation. The reinforcing member is not limited to that made of a metal plate but may be a solid metal rod, for example.

A plunging guide 60 is provided under the fixing nip 40, and a paper P having an unfixed toner image T formed on a surface thereof is introduced into the fixing nip 40 by the plunging guide 60. Above the fixing nip 40 is provided a pair of ejection guides 62. The ejection guides 62 serve to subserviently guide the paper P ejected from the fixing nip 40 and serve to separate the paper P tending to attach to the fixing belt 12 or the pressurizing roller 50.

When the pressurizing roller 50 is driven to rotate in the direction of the arrow A, in the belt-type fixing device 10 with the configuration described above, the fixing belt 12 concomitantly moves and rotates in a direction of an arrow B while sliding on the surface of the nip forming member 20. While the fixing belt 12 rotates in such a manner, an overall periphery of the fixing belt 12 is heated by the heating roller 14 and temperatures of the fixing belt thereby rise to a specified fixation temperature (e.g., 180° C.).

After the fixing belt 12 is heated so as to have the specified fixation temperature, the paper P having the unfixed toner image T formed on the surface thereof is introduced into the fixing nip 40 from lower side. Thus the toner image T is fixed onto the paper form P while the paper is passed through the fixing nip 40. The paper form P having passed through the fixing nip 40 is conveyed upward while being guided subserviently by the ejection guides 62, and is then ejected to outside of the image forming apparatus.

In the belt-type fixing device 10 of the embodiment, as described above, the surface 22 of the nip forming member 20 that is opposite to the pressurizing roller 50 is configured as the curved surface extending along the outer circumferential surface of the pressurizing roller 50, and the pressure distribution in the fixing nip 40 is thereby made generally flat with respect to the paper feeding direction, so that paper conveying velocities are made uniform throughout the fixing nip 40. Thus stress is prevented from acting on a paper passing through the fixing nip 40, and image noise such as image blur, wrinkles of paper and the like are thereby prevented from occurring.

In the belt-type fixing device 10 of the embodiment, the fixing nip having a desired width can be obtained with adequate setting of a width of the nip forming member 22. Accordingly, the fixing nip 40 having a large width, for example, of 12 mm is easily obtained by a comparatively low nip pressure, in contrast to a conventional fixing device in which a fixing nip is formed between two rollers and which requires a considerably large contact pressure for obtainment of a wide fixing nip. Thus nip time required for fixation is ensured by the wide fixing nip 40, so that increase in system speed of the image forming apparatus can be addressed.

The fixing device can be miniaturized and a circumference of the fixing belt 12 can be shortened by substitution of the nip forming member 20 for a fixing roller having an elastic layer on an outer circumference thereof which roller has been used in conventional belt-type fixing devices. Thus the fixing belt 12 can be shortened so that a heat capacity of the fixing belt 12 and heat release from the fixing belt 12 are reduced. Furthermore, substitution of the nip forming member 20, e.g., made of resin with a small heat capacity for a fixing roller having an elastic layer with a large heat capacity increases a rate at which temperatures rise in the fixing belt being heated by the heating roller 14. As a result, warm-up time at a start and recovery time from printing-standby status can be shortened.

On condition that a pressure contact load of the pressurizing roller 50 is variable in accordance with a type of a paper P in the belt-type fixing device 10 of the embodiment, positions of an entrance and an exit of the fixing nip 40 do not change so much as those in a conventional fixing device in which a fixing nip is formed between two rollers. Therefore, deterioration is prevented in performance on plunge of paper P into the fixing nip 40 and performance on separation of paper P ejected from the fixing nip 40.

<Nip Time Required for Ensuring Strength of Fixation>

Figure 2:
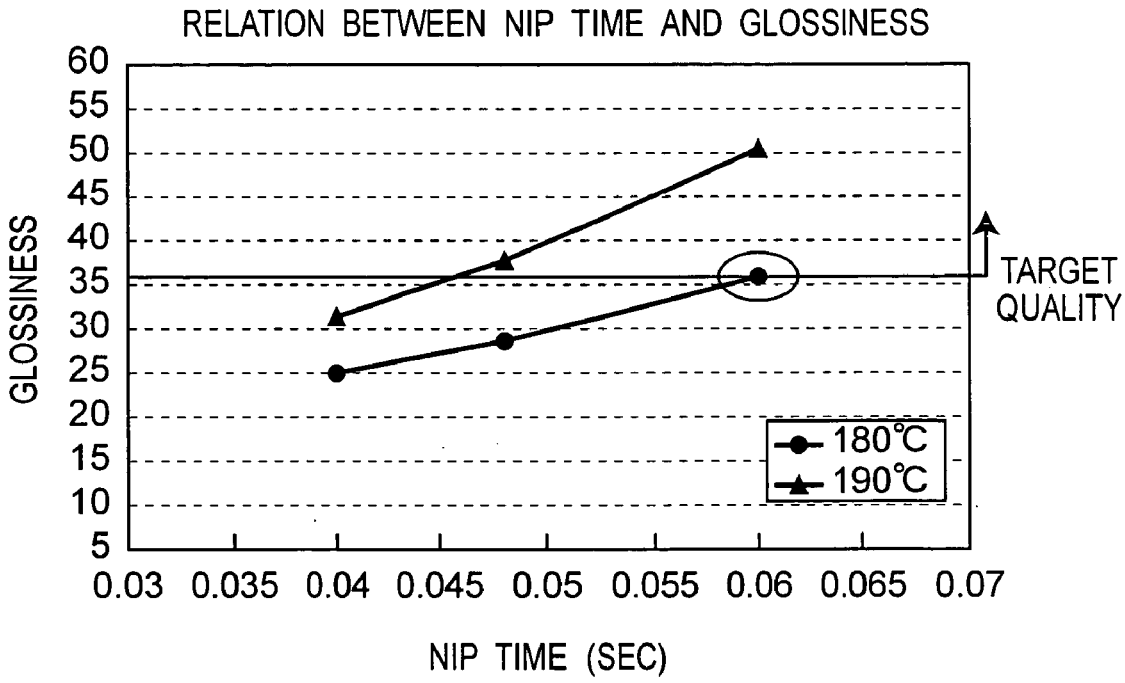
FIG. 2 is a graph illustrating relations between nip time and glossiness.

As shown in a graph of FIG. 2, a decrease in nip time (time required for passage of a point on a paper through the fixing nip 40) causes a decrease in glossiness of a fixed image. For example, a nip width of 6 mm and a system speed of 100 mm/sec in the image forming apparatus results in nip time of 0.06 second, which ensures a glossiness of 35 as target quality at a conventional fixation temperature of 180° C. Increase in the system speed, e.g., to 150 mm/sec for speedup of the apparatus, however, provides a nip time of 0.04 second and decreases the glossiness by about 10. For achievement of the target quality by increase in the fixation temperature, in this case, temperature increase by not less than 10° C. is required. In the belt-type fixing device 10 of the embodiment, the nip width of 12 mm is ensured in the fixing nip 40, and therefore satisfactory glossiness is obtained at the conventional fixation temperature even with increased system speed.

<Condition for Ensuring Nip Width>

Figure 3:
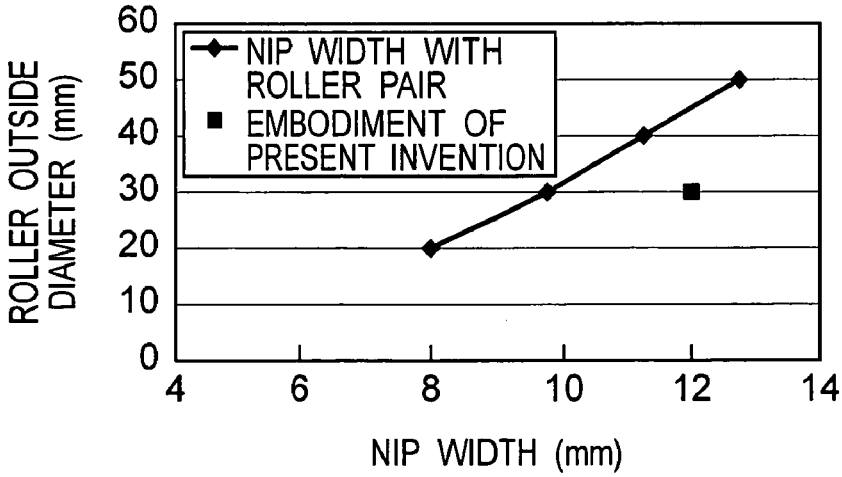
FIG. 3 is a graph illustrating relations between nip widths and outside diameters of rollers.

In a fixing nip formed of a pair of rollers in pressure contact with each other or formed by pressure contact of a roller with a flat-shaped nip forming member, as shown in a graph of FIG. 3, a large nip width for addressing an increase in system speed requires the rollers to have large diameters. The graph of FIG. 3 is a result of measurement performed under a condition that elastic layers of the rollers had a thickness of 4 mm, a ratio of strain of 20%, a hardness of JIS-A 20, and a length of 241 mm with respect to a longitudinal direction of the rollers. In the belt-type fixing device 10 of the embodiment, by contrast, the nip width of 12 mm is ensured with the pressurizing roller 50 having the outside diameter of 30 mm, as described above.

Figure 4:
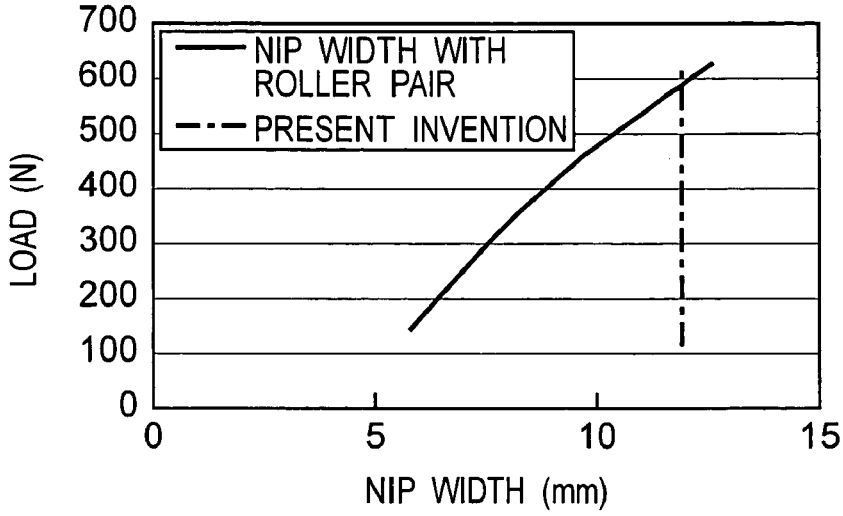
FIG. 4 is a graph illustrating relations between nip widths and pressure contact loads.

An increase in the nip width as shown in FIG. 3 requires a larger pressure contact load as shown in a graph of FIG. 4. In the belt-type fixing device 10 of the embodiment, by contrast, the nip forming member 20 is shaped so as to extend along the outer circumferential surface of the pressurizing roller 50 and a required nip width is thereby ensured easily irrespective of the load.

<Pressure Distribution in Fixing Nip>

Figures 5A, 5B:
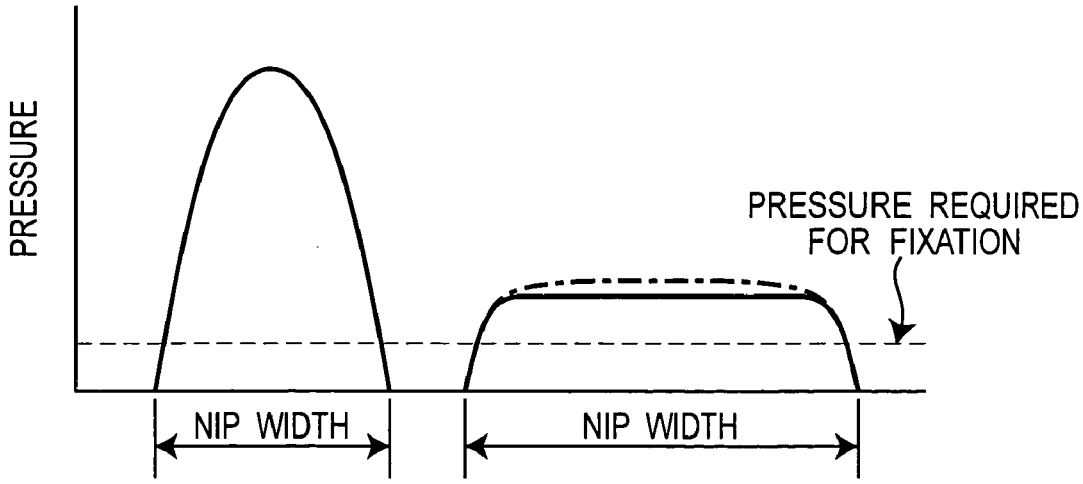
FIGS. 5A and 5B are graphs illustrating pressure distributions in fixing nips.

In a graph of FIG. 5A is shown a pressure distribution in a nip formed by a pair of rollers or by a flat-shaped nip forming member and a roller. The graph shows that a large pressure contact load for ensuring a nip width provides a prominently high pressure in center part of the nip width, in particular, and causes a great difference in pressure in the nip.

In the belt-type fixing device 10 of the embodiment, as shown in a graph of FIG. 5B, a pressure distribution in the fixing nip 40 is generally flat and there is little difference in pressure. Herein, "generally flat" status includes status in which pressures in center part of the nip are slightly higher than pressures at both sides of the nip (that is, an entrance side and an exit side of the nip), as shown by an alternate long and short dash line in the graph of FIG. 5B.

It has been found that a mean pressure in a nip not less than about 100 kPa is required for ensuring a fixity and a paper feedability. For the fixing nip 40 with the nip width of 12 mm and the length of the elastic layer 54 of 241 mm, accordingly, the fixity and the paper feedability are ensured with a pressure contact load not less than about 290 N. In comparison with a conventional fixing device of roller pair type that requires a pressure contact load a little less than 600 N, that is to say, it is sufficient for the belt-type fixing device 10 of the embodiment to have about half the pressure contact load.

For the formation of a wide nip for addressing increase in the system speed, as apparent from the above description, the fixing nip 40 formed of the one roller 50 and the member 20 with the shape extending along the outer circumference of the roller 50 makes it possible to provide a fixing nip required for ensuring a fixity, without increase in the roller diameter and with a lower pressure contact load, in comparison with a nip formed of a pair of rollers.

<Amount of Strain in Pressurizing Roller and Curl Correction>

The pressurizing roller 50 having a surface hardness of Asker C 50, a thickness of rubber of the elastic layer 54 of 4 mm, and an outside diameter of 30 mm was brought into pressure contact with the curved surface 22 of the nip forming member 20 having a radius of curvature of 15.4 mm, and the fixing nip 40 with the nip width of 12 mm was thereby formed. Under this condition, a curl height of a paper having passed through the fixing nip 40 varied with the pressure contact load. Herein, "curl height" corresponds to a quantity of lift caused by curl at ends of a paper that has passed through the fixing nip and that is laid on a flat surface.

Figure 6:
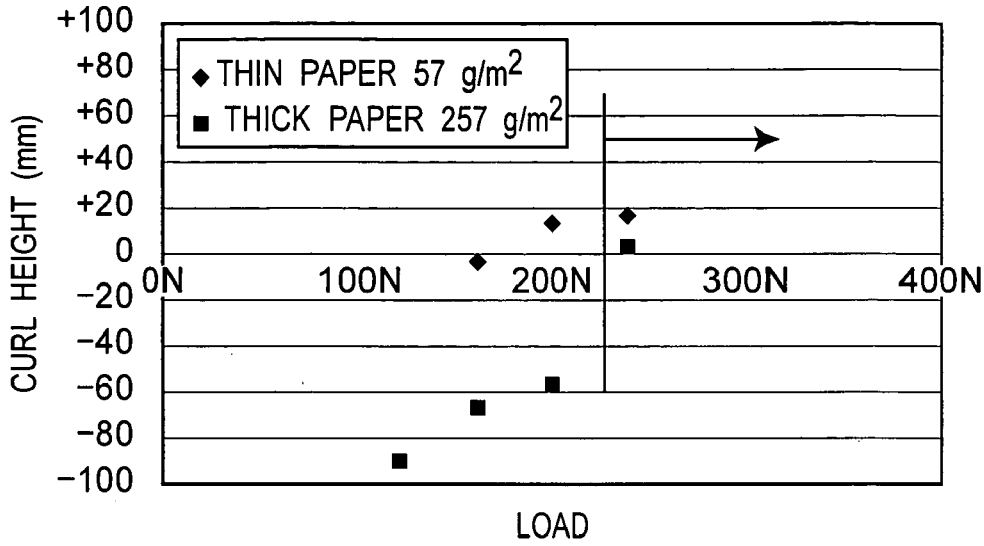
FIG. 6 is a graph illustrating relations between pressure contact loads and curl heights.

As shown in a graph of FIG. 6, it was observed that curl heights of both thin paper and thick paper were reduced with pressure contact loads not less than about 230 N. In the belt-type fixing device 10 of the embodiment with a pressure contact load of 230 N, a radial strain of 0.3 mm occurred in the elastic layer 54 of the pressurizing roller 50, and then a mean pressure in the nip was about 80 kPa. It was also observed that curl of a paper was corrected and the curl height was reduced with a radial strain not less than 0.3 mm in the elastic layer 54 of the pressurizing roller 50 which strain had been caused by the nip forming member 20 on the exit side of the fixing nip 40. Accordingly, the nip forming member 20 preferably causes a radial strain not less than 0.3 mm in the elastic layer 54 of the pressurizing roller 50 with a mean pressure not less than 80 ·kPa, for correction of curl of a paper.

<Relation Between Heat Conduction in Pressurizing Roller and Warm-up Time>

In the belt-type fixing device 10 of the embodiment, the heat source (i.e., the heater lamp 16) is not provided in vicinity of the fixing nip 40 in which the fixing belt 12 comes into contact with toner T on a paper P, but the heat source is provided in a position away from the fixing nip 40. Accordingly, the fixing belt 12 heated by the heating roller 14 has to heat the toner T only with heat the belt itself has. For efficient transfer to the toner T of a quantity of heat the fixing belt 12 has, therefore, the fixing belt 12 that comes into contact with the heating roller 14 and with the toner T preferably has a high thermal conductivity, and other members preferably have low thermal conductivities.

In a warm-up operation in which a temperature of the belt-type fixing device 10 is increased from a room temperature in cold status where the heater 16 has been turned off, to a fixable temperature, for example, a difference in escape of a quantity of heat from the fixing belt 12 occurs depending on the thermal conductivity of the pressurizing roller 50, and the difference appears as a difference in warm-up time. Table 1 below shows a result of measurement of warm-up time (time required for temperature increase from a room temperature of 23° C. to a fixation temperature of 180° C. with rotation of the fixing belt 12) with an input power of 760 W. Herein, an experiment was carried out in which three types of rubber having different thermal conductivities were separately used to form three types of the elastic layer 54 of the pressurizing roller 50.

[Table 1]

| | Rubber A | Rubber B | Rubber C |
|---|---|---|---|
| Thermal conductivity (W/(m · K)) | 0.60 | 0.30 | 0.16 |
| Warm-up time | 45 sec | 36 sec | 33.5 sec |

In printing-standby status in which the heating roller 14 has been heated to a fixation temperature of 180° C. by the heater lamp 16 with the fixing belt 12 stopped, part of the fixing belt 12 that is not in contact with the heating roller 14 has been cooled and much time is therefore required for the fixing belt 12 to recover the temperature of 180° C. after the fixing belt 12 starts rotating on reception of a printing instruction. Table 2 below shows a result of measurement of recovery time between reception of a printing instruction in printing-standby status and recovery of the fixation temperature of 180° C. in the fixing belt 12 which measurement was performed with an input power of 760 W and with use of three types of rubber as the elastic layer 54 of the pressurizing roller 50 as is the case with the warm-up time measuring experiment.

TABLE 2

| | Rubber A | Rubber B | Rubber C |
|---|---|---|---|
| Thermal conductivity (W/(m · K)) | 0.60 | 0.30 | 0.16 |
| Recovery time | 33 sec | 17 sec | 13 sec |

As shown in Table 1 and Table 2, warm-up time and recovery time greatly differed between rubber A and rubber B, whereas both do not differed much between rubber B and rubber C. If recovery time not less than 17 seconds is required, a process and time have to be set apart for running the fixing device only for recovery of the fixing belt temperature after reception of a printing instruction, in consideration of time required between exposure and transfer in the image forming apparatus, paper conveying time between paper feeding and fixation, and the like. As a result, lengths of a paper feeding pass and a image forming pass cannot be utilized efficiently. Thus a thermal conductivity of the elastic layer 54 of the pressurizing roller 50 is preferably 0.3 W/(m·K) or less.

<Relation Between Thickness of Elastic Layer of Pressurizing Roller and Warm-Up Time>

Figure 7:
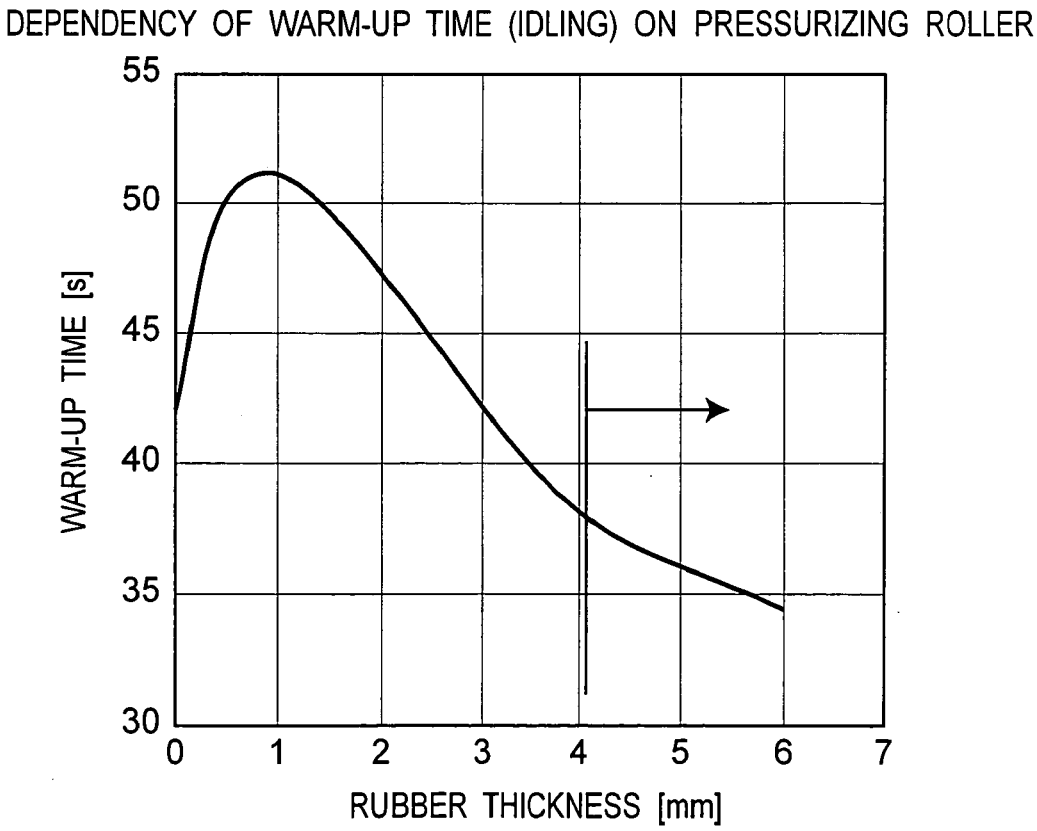
FIG. 7 is a graph illustrating a relation between rubber thicknesses of an elastic layer and warm-up time.

In order to reduce the warm-up time, as described above, it is effective to decrease escape of heat from the fixing belt 12 to the pressurizing roller 50. For purpose of the decrease, it is effective to increase a thickness of rubber of the elastic layer 54 that is part of the pressurizing roller 50 having a low thermal conductivity. As a result of measurement of the warm-up time with an input power of 760 W, as shown in a graph of FIG. 7, the larger the thickness of the rubber is, the faster the belt temperature increases because of an effect of thermal insulation and thus the shorter the warm-up time is. Thicknesses of the rubber of approximately 4 mm or more, however, saturate the effect of thermal insulation. Therefore, the thickness of the elastic layer 54 of the pressurizing roller 50 is preferably equal to or larger than about 4 mm.

<Driving Torque of Pressurizing Roller>

Though the nip forming member 20 is reinforced by the reinforcing member 30, the pressure by the pressurizing roller 50 causes the nip forming member 20 to have flexure in directions orthogonal to the longitudinal direction because the reinforcing member 30 cannot be a completely rigid body. The flexure peaks in middle part of the nip forming member 20 with respect to the longitudinal direction. By such flexure of the nip forming member 20, pressures in the fixing nip 40 are increased at both ends and are decreased in the middle part with respect to the longitudinal direction. Thus amounts of strain in the elastic layer 54 of the pressurizing roller 50 are increased at both the ends and are decreased in the middle part. With such variation in amount of strain in the elastic layer 54 of the pressurizing roller 50 with respect to an axial direction, the paper conveying velocities are increased at both the ends where amounts of strain are large, whereas the velocities are relatively decreased in the middle part where amounts of strain are small. Consequently, a paper tends to be fed faster at both the ends, while feed of the paper is retarded in the middle part. Then the relative decrease in the paper conveying velocity in the middle part acts like brake, and a driving torque of the pressurizing roller 50 is thereby increased. The difference in the paper conveying velocity in the fixing nip 40 causes image noise, wrinkles of paper and the like.

Figure 8:
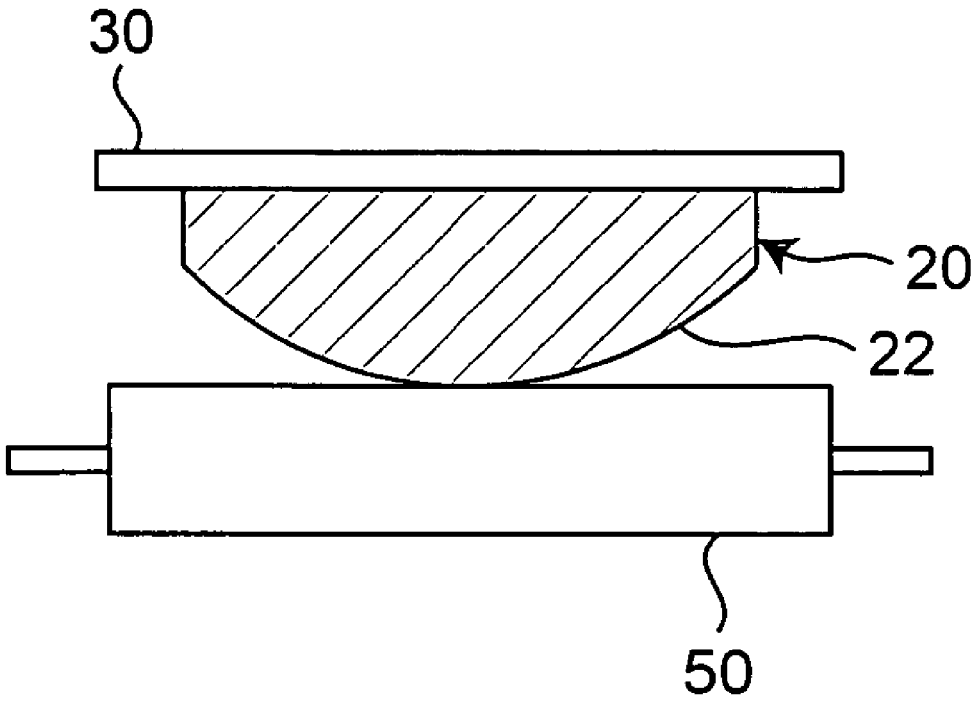
FIG. 8 is a diagram illustrating a longitudinal cross section of a nip forming member.

In order to cancel the above-described influence of the flexure of the nip forming member 20, as shown in FIG. 8, the surface 22 of the nip forming member 20 that is opposite to the pressurizing roller 50 is preferably curved so that the middle part of the nip forming member 20 with respect to the longitudinal direction protrudes relative to both the ends toward the pressurizing roller 50. By the surface 22 of the nip forming member 20 configured as such a curved surface, a pressure distribution in the fixing nip 40 with respect to the longitudinal direction is made generally uniform even if the nip forming member 20 is flexed. Thus amounts of strain in the elastic layer 54 of the pressurizing roller 50 are made generally uniform with respect to the axial direction and the difference in the paper conveying velocity is thereby canceled. As a result, prevented are the increase in the driving torque of the pressurizing roller 50 and occurrence of image noise, wrinkles of paper and the like.

Hereinbelow, a belt-type fixing device 11 in accordance with a second embodiment of the invention will be described. A configuration of the belt-type fixing device 11 is generally the same as that of the belt-type fixing device 10 of the first embodiment, and major differences are as follows.

An elastic layer 54 of a pressurizing roller 50 preferably has a JIS-A hardness in a range from 5 to 40. That is because the hardness less than 5 causes a problem of permanent deformation of the elastic layer 54 and because the hardness greater than 40 decreases strain caused by the pressure contact against the nip forming member 20 and thus causes a deterioration in paper separating performance.

Nip loads in a fixing nip 40 (i.e., pressure contact loads of the pressurizing roller 50) are set in a range from 160 to 240 N, which results in a mean pressure in the fixing nip 40 in a range from 50 kPa to 250 kPa. The mean pressure less than 50 kPa prevents a driving force of the pressurizing roller 50 from being transmitted stably to a fixing belt 12, whereas the mean pressure greater than 250 kPa only increases a driving load on the fixing belt 12 and necessitates a motor having a larger power consumption.

A radius r1 of curvature of an opposite surface (or curved surface) 22 of a nip forming member 20 is set so as to satisfy an expression 1 below with respect to a radius r2 of curvature (15 mm in the embodiment) of an outer circumferential surface of the pressurizing roller 50. Provided that the radius r1 of curvature is set at 15.5 mm, a nip width of 12 mm is obtained. Thus the surface 22 of the nip forming member 20 that is opposite to the pressurizing roller 50 is configured as the curved surface extending along the outer circumferential surface of the pressurizing roller 50, and a pressure distribution in the fixing nip 40 is thereby made generally flat with respect to a paper feeding direction.

$$r2 \leqq r1 \leqq r2 \times K \qquad \text{[Expression 1]}$$

(wherein $1 \leqq K < 1.13$)

Configurations of other part of the belt-type fixing device 11 and operations of the belt-type fixing device 11 are the same as those of the belt-type fixing device 10, and description thereof is therefore omitted.

In accordance with the belt-type fixing device 11 of the embodiment, the surface 22, which is opposite to the pressurizing roller 50, of the nip forming member 20 which is fixed so as to be incapable of rotating has the radius r1 of curvature satisfying the expression 1 and is configured as the curved surface extending along the outer circumferential surface of the pressurizing roller 50, so that the pressure distribution in the fixing nip 40 is made generally flat with respect to the paper feeding direction. Thus paper conveying velocities are made uniform throughout the fixing nip 40. Consequently, stress is prevented from occurring in a paper passing through the fixing nip 40, and image noise such as image blur, wrinkles of paper and the like are thereby prevented from occurring.

Besides, the fixing nip 40 having a desired width (e.g., 12 mm) can be obtained with adequate setting of the width of the nip forming member 20. Accordingly, the fixing nip 40 having a large width is easily obtained by a comparatively small contact pressure, e.g., of 160 to 240 N, in contrast to a conventional fixing device in which a fixing nip is formed between two rollers and which requires a large contact pressure, e.g., of 480 N, for obtainment of a 9 mm-wide fixing nip, for example. Thus nip time required for fixation is ensured by the wide fixing nip 40, so that increase in system speed of the image forming apparatus can be addressed.

Figure 9:
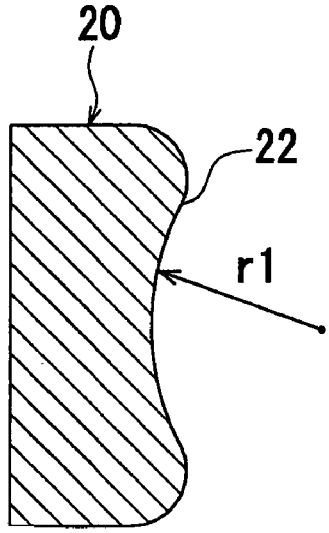
FIG. 9 is a diagram illustrating a radius of curvature of a curved surface of a nip forming member.

Hereinbelow, an experiment with the belt-type fixing device 11 of the embodiment will be described. Nip widths, conveying velocities, and torques of the pressurizing roller 50 were measured under a condition that the radius r1 of curvature of the curved surface 22 of the nip forming member 20 was varied as shown in FIG. 9 with respect to a radius r2 of curvature of the outer circumferential surface of the pressurizing roller 50 of 15 mm. A result of the experiment is shown below in Table 3. In a column of "Nip width" of Table 3, reference character "O" indicates that the nip width was not less than 10.5 mm, and character "Δ" indicates that the nip width was less than 10.5 mm. In a column of "Conveying velocity," character "X" indicates that the conveying velocity was 3% or above lower than a desired conveying velocity (e.g., 150 mm/sec). In a column of "Torque," character "X" indicates that torque-up occurred, and character "–" indicates that data was not acquired because reduction in the torque caused by occurrence of slip made measurement meaningless. A coefficient K is the radius r1 of curvature of the nip forming member 20 divided by the radius of curvature of the pressurizing roller 50 of 15 mm.

TABLE 3

| r1 | Nip width | Conveying velocity | Torque | Coefficient K |
|---|---|---|---|---|
| 14.5 | ○ | ○ | X | 0.97 |
| 15.0 | ○ | ○ | ○ | 1.00 |
| 15.5 | ○ | ○ | ○ | 1.03 |
| 16.5 | ○ | ○ | ○ | 1.10 |
| 17.0 | Δ | X | — | 1.13 |
| 18.0 | Δ | X | — | 1.20 |
| ∞ (flat) | X | ○ | ○ | ∞ |

As shown in Table 3, it is undesirable that the coefficient K is smaller than 1 (i.e., the radius r1 of curvature of the nip forming member 20 is smaller than the radius of curvature of the pressurizing roller 50 of 15 mm), because bite of the nip forming member 20 into the elastic layer 54 of the pressurizing roller 50 on the entrance side and the exit side of the fixing nip 40 leads to torque-up of the pressurizing roller 50. On the other hand, it is undesirable that the coefficient K is not less than 1.13, because the nip width then falls below 10.5 mm and a desired wide fixing nip 40 cannot be obtained and because occurrence of slip in the fixing nip 40 reduces the conveying velocity. It is therefore found that the coefficient K is preferably not less than 1 and less than 1.13.

In this experiment, the nip width of 12 mm was ensured under a condition that the radius r1 of curvature of the nip forming member 20 was 15.5 mm. In an experiment with a flat nip forming member 20 (having an infinite radius r1 of curvature) for reference, a nip width was 6 mm. With the nip width of 6 mm, an increase in system speed up to 150 mm/sec reduces nip time so that a fixity cannot be ensured.

Figure 10A:
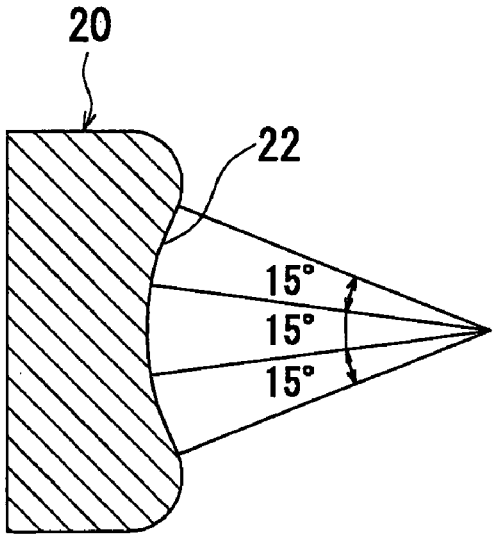
FIGS. 10A and 10B are diagrams illustrating radii of curvature of curved surfaces of nip forming members used in an experiment.
Figure 10B:
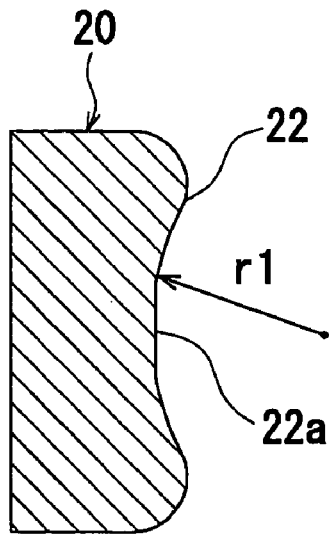

In another experiment with the belt-type fixing device 11, in a manner similar to the above experiment, nip widths, conveying velocities, and torques of the pressurizing roller 50 were measured under conditions that a 45° nip forming range of the curved surface 22 of the nip forming member 20 was divided into 15° third parts and that a radius r1 of curvature of the 15° center range was made to differ from a radius r1 (15.4 mm) of curvature of 15° ranges at both sides, as shown in FIG. 10A, and under conditions that a flat part having a width of 1 mm, 2 mm, and 3 mm, respectively, was provided in a center part 22*a* of the curved surface 22 (having a radius r1 of curvature of 15.4 mm) of the nip forming member 20, as shown in FIG. 10B. A result of the experiment is shown below in Table 4. In a column of "Nip width" of Table 4, reference character "O" indicates that the nip width was not less than 10.5 mm. In a column of "Conveying velocity," character "X" indicates that the conveying velocity was 3% or above lower than a desired conveying velocity (e.g., 150 mm/sec). In a column of "Torque," character "X" indicates that the torque-up occurred. A coefficient K is a mean radius r1 of curvature of the nip forming member 20 divided by a radius of curvature of the pressurizing roller 50 of 15 mm. For radii r1 of curvature that were not even, a large number of points were plotted on a curved surface 22 shown in FIGS. 10A and 10B, an approximate circle passing through the points was found, and a radius of the approximate circle was regarded as the mean radius r1 of curvature.

TABLE 4

| r1 | Mean r1 | Nip width | Conveying velocity | Torque | Coefficient K |
|---|---|---|---|---|---|
| 15.4-16.4-15.4 | 15.7 | ○ | ○ | ○ | 1.05 |
| 15.4-17.4-15.4 | 15.9 | ○ | ○ | ○ | 1.06 |
| 15.4-18.4-15.4 | 16.1 | ○ | ○ | ○ | 1.07 |
| 15.4-19.4-15.4 | 16.3 | ○ | ○ | ○ | 1.09 |
| 15.4-20.4-15.4 | 16.5 | ○ | ○ | ○ | 1.10 |
| Center flat 1 mm | 16.7 | ○ | ○ | ○ | 1.11 |
| Center flat 2 mm | 18.2 | ○ | ○ | ○ | 1.21 |
| Center flat 3 mm | 19.7 | ○ | X | X | 1.31 |

As shown in Table 4, it is undesirable that the coefficient K is 1.31, because occurrence of slip in the fixing nip 40 reduces the conveying velocity and because a driving torque of the pressurizing roller 50 is increased. It is therefore found that the coefficient K in this case is preferably not less than 1 and not more than 1.3.

In the belt-type fixing devices 10 and 11, the fixing belt 12 is heated by the heating roller 14 having the heater lamp 16 as a heat source therein; however, the devices may be configured so that the fixing belt 12 is heated by a heat source provided in contact with or adjacent to the fixing belt 12 at a location other than that of the heating roller.

The fixing belt 12 may be heated by a sheet-like heater that is substituted for the heating roller 14 and that cannot be rotated.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A belt-type fixing device comprising a one-piece nip forming member that is fixed inside an endless-sheet-like fixing belt to be heated so as to be incapable of rotating, and a rotatable pressurizing roller that is in pressure contact with the nip forming member with the fixing belt interposed between, wherein a contact part between the fixing belt and the pressurizing roller forms a fixing nip, the only fixing nip is formed only by the one-piece nip forming member, and a surface of the nip forming member that is opposite to the pressurizing roller is configured as a curved surface extending along an outer circumferential surface of the pressurizing roller so that a pressure distribution in the fixing nip is made generally flat with respect to a paper feeding direction.

2. A belt-type fixing device as claimed in claim 1, wherein the pressurizing roller has an elastic layer on an outer circumference thereof and the nip forming member comprises material that is harder than the elastic layer.

3. A belt-type fixing device as claimed in claim 2, wherein the nip forming member causes a radial strain not less than 0.3 mm in the elastic layer of the pressurizing roller with a mean pressure not less than 80 kPa.

4. A belt-type fixing device as claimed in claim 2, wherein a thickness of the elastic layer of the pressurizing roller is not less than 4 mm.

5. A belt-type fixing device as claimed in claim 1, further comprising-a heat source for heating the fixing belt, in a position away from the fixing nip, wherein a thermal conductivity of the elastic layer of the pressurizing roller is 0.3 W/(m·K) or less.

6. A belt-type fixing device as claimed in claim 1, wherein a radius r1 of curvature of the curved surface and a radius r2 of curvature of the pressurizing roller are set so that a relation of a following expression 1 holds:

$$r2 \leqq r1 \leqq r2 \cdot K \quad \text{(expression 1)}$$

(wherein $1 \leqq K < 1.13$).

7. A belt-type fixing device as claimed in claim 6, wherein the pressurizing roller has an elastic layer on an outer circumference thereof and the elastic layer has a JIS-A hardness in a range from 5 to 40.

8. A belt-type fixing device as claimed in claim 6, wherein a mean pressure in the fixing nip is not less than 50 kPa and not more than 250 kPa.

9. A belt-type fixing device as claimed in claim 6, wherein the fixing belt is wound around a rotatable heating roller having a heat source and around the nip forming member provided in a position away from the heating roller.

10. A belt-type fixing device as claimed in claim 1, wherein a mean radius r1 of curvature of the curved surface and a radius r2 of curvature of the pressurizing roller are set so that a relation of a following expression 2 holds:

$$r2 \leqq r1 \leqq r2 \cdot K \quad \text{(expression 2)}$$

(wherein $1 \leqq K \leqq 1.3$).

11. A belt-type fixing device for fixing a toner image on a paper, the belt-type fixing device comprising:

an endless-sheet-like belt member, a pressurizing roller which has an elasticity and on which the paper is passed through a fixing nip that is contact part between the pressurizing roller and an outer circumferential surface of the belt member, and a one-piece nip forming member that is harder than the pressurizing roller, that is positioned inside the belt member, that relatively presses the belt member against the pressurizing roller, and that has a pressing surface opposite to the pressurizing roller and formed of a curved surface extending along an outer circumferential surface of the pressurizing roller, wherein the only fixing nip is formed only by the one-piece nip forming member.

12. A belt-type fixing device as claimed in claim 11, wherein a radius of curvature of the pressing surface of the nip forming member is substantially equal to a radius of curvature of the outer circumferential surface of the pressurizing roller.

13. A belt-type fixing device as claimed in claim 11, wherein a radius r1 of curvature of the pressing surface of the nip forming member and a radius r2 of curvature of the outer circumferential surface of the pressurizing roller are set so that a relation of a following expression 3 holds:

$$r2 \leqq r1 \leqq r2 \cdot K \quad \text{(expression 3)}$$

(wherein $1 \leqq K < 1.13$).

14. A belt-type fixing device as claimed in claim 11, wherein the pressing surface of the nip forming member is formed of one and same material continuously.

15. A belt-type fixing device as claimed in claim 11, wherein the pressurizing roller is driven to rotate, and the belt member follows the pressurizing roller and thereby rotates.

* * * * *